US007869610B2

(12) United States Patent
Jayanth et al.

(10) Patent No.: US 7,869,610 B2
(45) Date of Patent: Jan. 11, 2011

(54) BALANCED ARMATURE BONE CONDUCTION SHAKER

(75) Inventors: Vignesh Jayanth, Chicago, IL (US); Henry G. Nepomuceno, Glendale Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 1304 days.

(21) Appl. No.: 11/290,006

(22) Filed: Nov. 30, 2005

(65) Prior Publication Data

US 2007/0121983 A1 May 31, 2007

(51) Int. Cl.
*H04R 25/00* (2006.01)
*H04R 1/00* (2006.01)

(52) U.S. Cl. ..... 381/177; 381/418

(58) Field of Classification Search ..... 381/177, 381/345, 369, 380, 417, 418
See application file for complete search history.

(56) References Cited

U.S. PATENT DOCUMENTS

| | | | |
|---|---|---|---|
| 3,701,865 | A | 10/1972 | Carlson et al. |
| 4,126,769 | A | 11/1978 | Broersma |
| 5,913,815 | A | 6/1999 | Ball et al. |
| 6,141,427 | A | 10/2000 | Fukuda |
| 6,643,378 | B2 | 11/2003 | Schumaier |
| 6,668,065 | B2 | 12/2003 | Lee et al. |
| 6,839,443 | B2 | 1/2005 | Fukuda |
| 2003/0048915 | A1 | 3/2003 | Bank |
| 2004/0167377 | A1 | 8/2004 | Schafer et al. |

FOREIGN PATENT DOCUMENTS

| | | | |
|---|---|---|---|
| GB | 2 229 339 | | 9/1990 |
| WO | 2004/049756 | A1 | 6/2004 |
| WO | 2006/105268 | A2 | 10/2006 |

OTHER PUBLICATIONS

International Search Report for Application No. PCT/US06/021330 dated Nov. 21, 2006.
Mende, D; Simon, G: Physik - Gleichungen und Tabellen, pp. 46-49, 56-57.
German Examination Report for 112006006084.1-35.

*Primary Examiner*—Brian Ensey
(74) *Attorney, Agent, or Firm*—Fitch, Even, Tabin & Flannery

(57) ABSTRACT

A bone conduction transducer suitable for use in a listening device, such as hearing aids, in-ear monitors, headphones, electronic hearing protection devices, and very small scale acoustic speakers, has an end mass assembly disposed within the housing. The end mass assembly is mounted to the acoustic assembly and operatively coupled to the motor assembly via a coupling assembly.

15 Claims, 3 Drawing Sheets

BALANCED ARMATURE BONE CONDUCTION SHAKER

TECHNICAL FIELD

This patent generally relates to transducers useful in listening devices, such as hearing aids or the like, and more particularly, to a balanced armature bone conduction receiver, by which a user is capable of listening to sound by direct transmission of vibrations to the skeleton structure.

BACKGROUND

Hearing aids are one type of ear worn acoustic device, and the technology to implement hearing aids and other types of ear worn acoustic devices has progressed rapidly in recent years. Technological advancements in this field continue to improve the miniaturization, reception, wearing comfort, life-span, and power efficiency of these devices and well as permit an increasing number of styles and types of these devices. For example, there are several different hearing aid styles which include: Behind-The-Ear (BTE), In-The-Ear or All-In-The-Ear (ITE), In-The-Canal (ITC), and Completely-In-The-Canal (CIC). With the continual advances in the performance of ear-worn acoustic devices and demand for new types or styles of ear worn acoustic devices, ever-increasing demands are placed upon improving the inherent performance of the miniature acoustic transducers that are utilized.

Generally, a listening device, such as a hearing aid or the like, includes a microphone assembly, an amplifier and a receiver (speaker) assembly. The microphone assembly receives acoustic waves, and generates an electronic signal representative of these sound waves. The amplifier accepts the electronic signal, modifies the electronic signal, and communicates the modified electronic signal (e.g. processed signal) to the receiver assembly. The receiver assembly, in turn, converts the processed electronic signal into acoustic energy for transmission to a user.

Bone conduction speakers have been developed in various types to sense audible sounds through bone vibrations and to transmit the converted vibrations to the cochlea. The bone conduction speaker may include a yoke, a voice coil, a magnet, a diaphragm, a spring, and a vibration block housed within a case. The vibration block has its central portion mounted to the inner surface of the case through, for example, a plurality of screws. The spring has its outer peripheral portion fixedly embedded in an inner surface of the housing, and has its central portion fixedly mounted to a lower surface of a central portion of the yoke. This arrangement of the assembly has several disadvantages. Manufacture and assembly of the typical speaker may require complex, labor intensive particularly centering the vibration block to the case. Also, the physical volume of the material places limits on the size of the speaker making size reductions difficult.

BRIEF DESCRIPTION OF THE DRAWINGS

For a more complete understanding of the disclosure, reference should be made to the following detailed description and accompanying drawings wherein.

DETAILED DESCRIPTION

Figure 1:
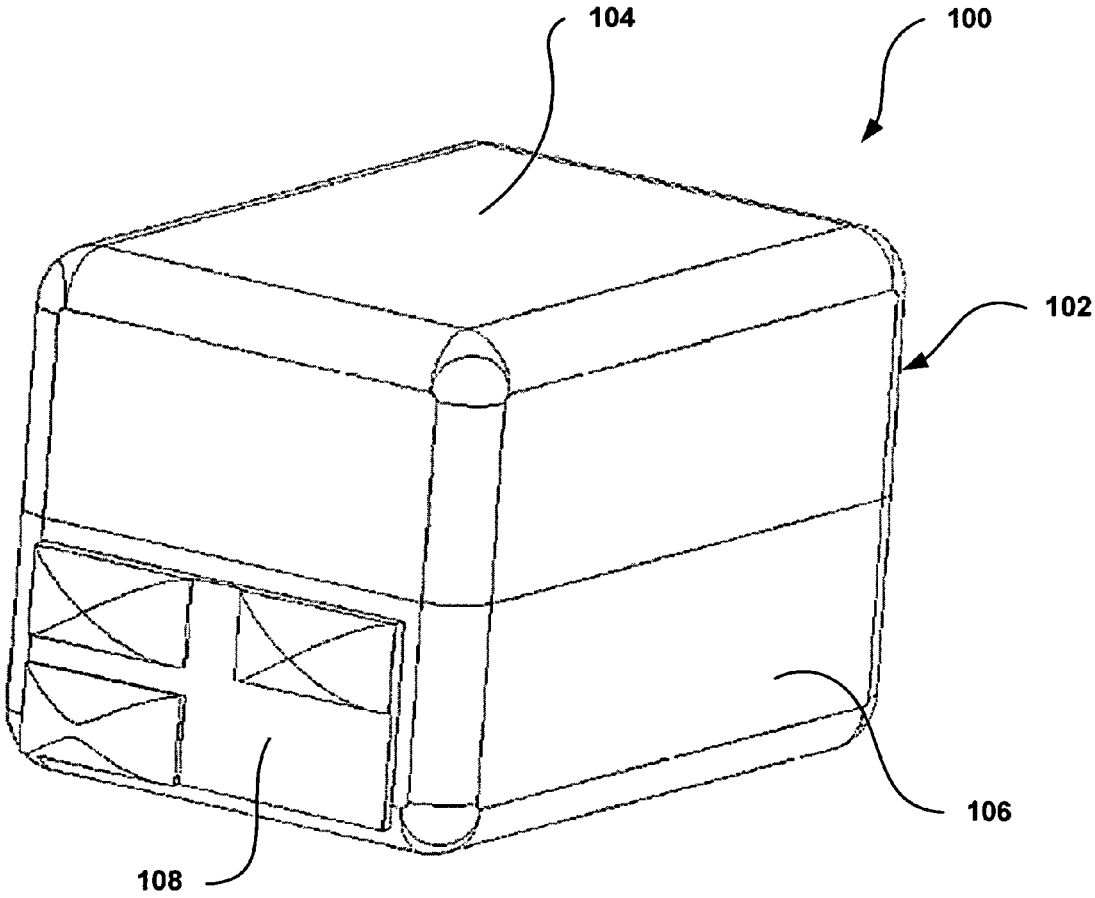
FIG. 1 is a perspective view of a described embodiment of a balanced armature bone conduction shaker.

While the present disclosure describes embodiments of structures and methods susceptible to various modifications and alternative forms, the embodiments shown by way of example in the drawings and described in detail herein are presented by way of example. It will be understood, however, that this disclosure is not intended to limit the invention to the particular forms described, but to the contrary, the invention is intended to cover all modifications, alternatives, and equivalents falling within the spirit and scope of the invention defined by the appended claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

Figure 2:
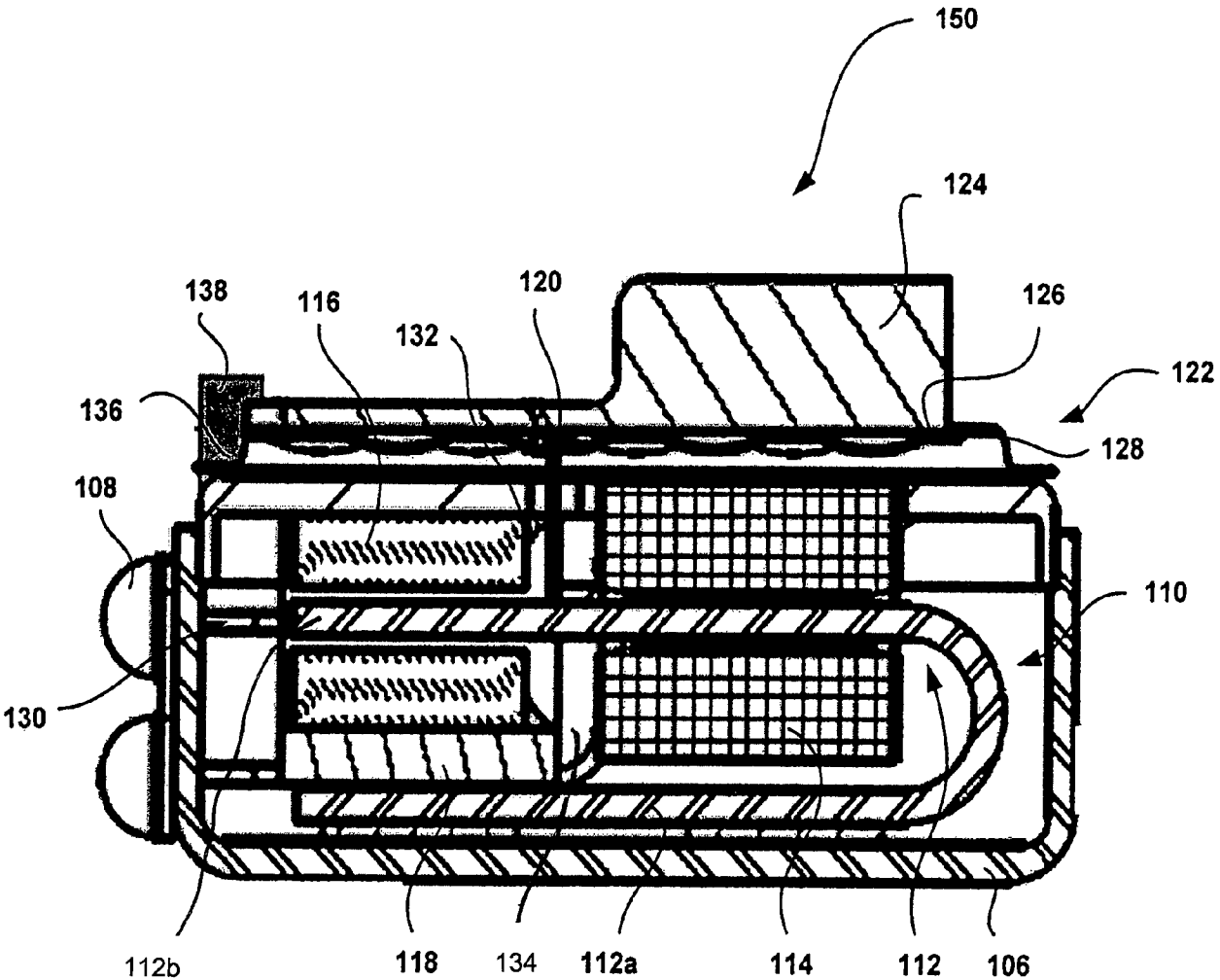
FIG. 2 is a cross-section view of a described embodiment of a balanced armature bone conduction shaker shown in FIG. 1.

FIG. 1 illustrates a perspective view of a balanced armature bone conduction transducer 100. The transducer 100 may be adapted as a receiver, a shaker or other such device, and may be useful in hearing aids, in-ear monitors, headphones, electronic hearing protection devices, and very small scale acoustic speakers. The bone conduction shaker 100 includes a housing 102 and an electrical terminal 108 affixed to the housing 102 by any suitable means. The housing 102 may be rectangular in shape with a cover 104 and a bottom 106 attached to the cover 104 by any suitable means. In alternate embodiments, the housing 102 can be manufactured in a variety of configurations, such as, a cylindrical shape, a D-shape, a trapezoid shape, a roughly square shape, or any other desired geometry. In addition, the scale and size of the housing 102 may vary based on the intended application operating conditions, required components, etc. The working components of the transducer (as shown in FIG. 2) are enclosed within the housing 102. In use, the transducer 100 is disposed within an acoustic device (not depicted) such that the housing 102 is closely coupled to the user's skeleton, i.e., the user's head adjacent the cochlea, to facilitate bone conduction of a acoustic signals.

FIG. 2 illustrates in cross-sectional view the working components 150 of the transducer 100. The components 150 may include a motor assembly 110, a coupling assembly 120, an acoustic assembly 122, and an end mass assembly 124. The motor assembly 110 may include an armature 112, a coil 114, a pair of magnets 116, and a magnetic yoke 118. The pair of magnets 116, which may act as drive magnets, is mounted within the magnetic yoke 118. A first air gap 130 may be formed between the pair of magnets 116 to receive the armature 112. The coil 114 defines a second air gap 132 adjacent to the first air gap 130 to receive the armature 112. A third air gap 134 may be formed between the coil 114 and the magnetic yoke 118 to receive the coupling assembly 120. To reduce the susceptibility to shocks, a snubber (not shown) may be provided to prevent potentially damaging deflections that may occur on the armature 112 as disclosed in U.S. patent application Ser. No. 60/721,251, the disclosure of which is incorporated herein by reference. The armature 112 may have a generally U-shaped strap with a fixed 112*a* and a movable end 112*b*. The movable end armature 112*a* extends through the air gaps 130, 132, 134 formed between the motor assembly 110. One skilled in the art will appreciate the principles and advantages of the embodiments described herein may be useful with all types of transducers, such as those using an E-shaped armature or of a different configuration.

The coupling assembly 120 may be a drive rod, a linkage assembly, a plurality of linkage assemblies, or the like and may be made of electrically conductive material. One end of the coupling assembly 120 may couple to the acoustic assembly 122 and the other end of the coupling assembly 120 may couple to the movable end of the armature 112*b* to drive the acoustic assembly 122. A positioning member (not shown) may be provided between the coil 114 and the magnetic yoke 118 for retaining the coupling assembly 120 as disclosed in the aforementioned U.S. Patent Application Ser. No. 60/721,251. Alternatively, the snubber, the positioning member, and the coil 114 may be molded into one piece to simplify the assembly during mass production. The acoustic assembly 122 may include a paddle 126 and a thin flexible film 128 attached to the paddle 126 by any suitable means. However, the acoustic assembly 122 may utilize multiple paddle layers as disclosed in U.S. Patent Application Ser. Nos. 60/665,700, 10/719,809, and 09/755,664, the disclosures of which are incorporated herein by reference. The motion of the acoustic assembly 122, and hence its performance, may be influenced by the materials used to make the acoustic assembly 122 and its resulting stiffness.

In one embodiment, the end mass assembly 124 is mounted to the top surface of the acoustic assembly 122 by any suitable means, such as bonding. Mounting the end mass assembly 124 to the acoustic assembly 122 may help facilitate control of the stiffness of the acoustic assembly 122 over a specified frequency range independent of the moving mass. The end mass assembly 124 may be made of a very hard material such as Tantalum or of any other similar materials, having a density about 13,000 kg/m$^3$-19,500 kg/m$^3$ or an elastic modulus of about 70 GPa-420 GPa may be employed to affect the resonant frequency of the overall acoustic assembly 122 or the moving mass of the acoustic assembly 122. A mass of adhesive 138 may be applied to a hinged portion 136 of the acoustic assembly 122 to increase the rigidity around the hinge 136 and to enhance control of the movement of the acoustic assembly 122. The pivoting movement about the hinge 136 provides control of the movement of the acoustic assembly 122 while delivering acoustic output sound pressure.

Alternatively, end mass assembly 124 may by a hybrid or composite structure. Such a structure may include a metal substrate, such as a steel substrate having a density of about 7850 Kg/m$^3$, to which is secured by bonding, welding, plasma/metal deposition or any suitable technique a second mass or structure, such as Niobiom mass having a density of 8570 kg/m$^3$, which when combined achieve a density and stiffness within the intended range. Furthermore, some of the mass of the end mass assembly may be incorporated into the diaphragm itself by altering its dimensions, e.g., thickening. The altered diaphragm may provide the desired mass and stiffness, and/or such an altered diaphragm may be combined with an end mass assembly that is specified to again achieved the desired mass and stiffness.

In operation, a current representing an input audio signal from the electrical terminal 108 is applied to the coil 114, a corresponding alternating current (a.c.) magnetic flux is produced from the coil 114 through the armature 112, drive magnet 116 and the magnetic yoke 118. Further, a corresponding direct current (d.c.) magnetic flux path is produced across the air gap. The movable end armature 112*b* vibrates in response to the electromagnetic forces generated by the magnetic flux produced by the motor assembly 110, which in turn, leads to the movement of the coupling assembly 120. The acoustic assembly 122 and the mass-end assembly 124 moves in response to the motion of the movable end armature 112*b* driven by the coil 114. The transducer 100 utilizes the corresponding motion of the movable end armature 112*b*, acoustic assembly 122, and the end mass assembly 124 to generate output acoustical signals such that a vibration of the end mass assembly 124 is transmitted to skeleton structure of the user, which makes it possible for the user to latch the sound.

Figure 3:
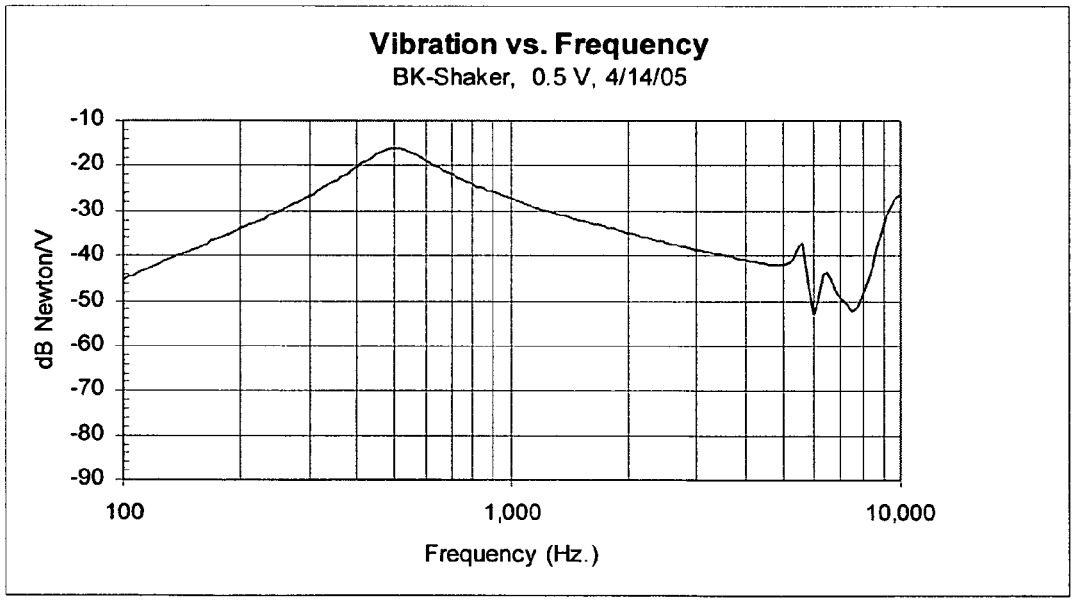
FIG. 3 is a graph illustrating the vibration response of the balanced armature bone conduction shaker.

FIG. 3 is a graph illustrating the vibration response of the balanced armature transducer 100. The graph indicates that the vibration response is improved (e.g. reduced). The transducer 100 has a peak frequency at 500 Hz within the frequency range for perception of unmodified speech.

All references, including publications, patent applications, and patents, cited herein are hereby incorporated by reference to the same extend as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An acoustic transducer comprising:

a housing for the transducer, the housing defining an interior and an exterior, an electrical terminal being disposed on the housing, the housing being configured without an audio port and disposed so as to create a close mechanical coupling with a skeletal structure of a user;

a motor assembly disposed within the housing and coupled to the electrical terminal to receive an electrical signal representative of an audio signal to be transduced, the motor assembly including a first magnet, a second magnet, a coil, and an armature;

such that the electrical signal is received by the coil and produces a current in the coil, the interaction of the current with the first magnet and the second magnet effective to produce a magnetic flux that moves at least a portion of the armature;

a coupling assembly coupled to the motor assembly;

an end mass assembly disposed within the housing and coupled to the coupling assembly;

such that the movement of the armature is effective to move at least a portion of the coupling assembly and cause a vibration of the end mass assembly, the end mass assembly configured to transmit the vibration through the housing to the adjacent skeletal structure of the user via the close mechanical coupling.

2. The acoustic transducer of claim 1, further comprising an acoustic assembly, the end mass assembly being bonded to the acoustic assembly.

3. The acoustic transducer of claim 2, the acoustic assembly having a surface, the end mass assembly being coupled to the surface.

4. The acoustic transducer of claim 2, the end mass assembly being bonded to the surface.

5. The acoustic transducer of claim 3, the end mass assembly affecting a mechanical property of the acoustic assembly.

6. The acoustic transducer of claim 5, the acoustic property being stiffness over a given frequency range.

7. The acoustic assembly of claim 1, the end mass assembly having a density from about 13,000 $kg/m^3$ to about 19,500 $kg/m^3$.

8. The acoustic assembly of claim 1, the end mass assembly having a density of about 16,650 $kg/m^3$.

9. The acoustic transducer of claim 1, the end mass assembly having an elastic modulus of about 70 GPa to about 420 GPa.

10. The acoustic transducer of claim 8, wherein the elastic modulus is about 184 GPa.

11. The acoustic transducer of claim 2, a hinge coupling the acoustic assembly within the housing for movement within the housing about the hinge, a mass being couple to the hinge and affecting a rigidity of the hinge.

12. The acoustic transducer of claim 9, the mass comprising a mass of adhesive.

13. The acoustic transducer of claim 1, the end mass assembly comprising a combination of a first material and a second material.

14. The acoustic transducer of claim 1, the end mass assembly comprising a substrate and a material mass formed on the substrate.

15. The acoustic transducer of claim 1, the end mass assembly comprising the diaphragm.

* * * * *

UNITED STATES PATENT AND TRADEMARK OFFICE

CERTIFICATE OF CORRECTION

PATENT NO. : 7,869,610 B2
APPLICATION NO. : 11/290006
DATED : January 11, 2011
INVENTOR(S) : Vignesh Jayanth and Henry G. Nepomuceno It is certified that error appears in the above-identified patent and that said Letters Patent is hereby corrected as shown below:

ON THE COVER PAGE:
Column 2, item (56), entitled "OTHER PUBLICATIONS", delete "112006006084" and insert --112006003084--.

Signed and Sealed this
First Day of November, 2011

David J. Kappos
*Director of the United States Patent and Trademark Office*